US010072615B2

(12) United States Patent
Pattullo

(10) Patent No.: US 10,072,615 B2
(45) Date of Patent: Sep. 11, 2018

(54) CARBURETOR AIR-FUEL MIXTURE ADJUSTMENT ASSEMBLY AND TOOLS

(71) Applicant: Walbro LLC, Tucson, AZ (US)

(72) Inventor: George M. Pattullo, Caro, MI (US)

(73) Assignee: Walbro LLC, Tucson, AZ (US)

( * ) Notice: Subject to any disclaimer, the term of this patent is extended or adjusted under 35 U.S.C. 154(b) by 30 days.

(21) Appl. No.: 15/337,349

(22) Filed: Oct. 28, 2016

(65) Prior Publication Data

US 2017/0130677 A1 May 11, 2017

Related U.S. Application Data

(60) Provisional application No. 62/251,997, filed on Nov. 6, 2015.

(51) Int. Cl.

| | |
|---|---|
| ***F02M 9/00*** | (2006.01) |
| ***F02M 9/08*** | (2006.01) |
| ***F02M 19/04*** | (2006.01) |
| ***B01F 3/04*** | (2006.01) |
| ***F02M 19/01*** | (2006.01) |
| ***B25B 13/48*** | (2006.01) |
| ***B25B 23/10*** | (2006.01) |
| ***B25B 27/00*** | (2006.01) |

(52) U.S. Cl.

CPC ..... *F02M 9/08* (2013.01); *B01F 3/0446* (2013.01); *B25B 13/48* (2013.01); *B25B 23/103* (2013.01); *B25B 23/105* (2013.01); *B25B 27/0035* (2013.01); *F02M 19/01* (2013.01); *F02M 19/04* (2013.01); *B01F 2215/0088* (2013.01)

(58) Field of Classification Search

CPC ..... F02M 9/08; F02M 19/04; F02M 19/01; F02M 3/08

USPC ..... 261/44.6, 44.8, 71, DIG. 38, DIG. 84

See application file for complete search history.

(56) References Cited

U.S. PATENT DOCUMENTS

| | | | | |
|---|---|---|---|---|
| 4,234,524 | A | 11/1980 | Arai | |
| 5,707,561 | A * | 1/1998 | Swanson | F02M 3/10 137/382 |
| 7,070,173 | B2 | 7/2006 | Dow et al. | |

* cited by examiner

*Primary Examiner* — Robert A Hopkins

(74) *Attorney, Agent, or Firm* — Reising Ethington P.C.

(57) ABSTRACT

A carburetor with a fuel adjustment tamperproof valve assembly and specialized tools for adjusting the valve assembly. A needle valve is received in a recess in a carburetor body with a passage open to the exterior of the body and a cylindrical surface of the passage. A valve head with a cylindrical exterior surface is received in the passage with a slight clearance between them. The specialized tools are engageable with the head to adjust the valve by rotating it.

23 Claims, 7 Drawing Sheets

CARBURETOR AIR-FUEL MIXTURE ADJUSTMENT ASSEMBLY AND TOOLS

REFERENCE TO RELATED APPLICATIONS

This application claims the benefit of U.S. Provisional Patent Application Ser. No. 62/251,997, filed on Nov. 6, 2015, which is incorporated herein by reference in its entirety.

TECHNICAL FIELD

This invention relates generally to carburetors for engines and more particularly to an assembly for adjusting the air-to-fuel ratio of an air-fuel mixture supplied by a carburetor to an operating engine.

The United States Environmental Protection Agency (EPA), California Air Regulation Board (CARB) and other domestic and foreign governmental organizations and agencies have established engine exhaust gas air pollution regulations and limits which can be exceeded by improper adjustment and/or setting of the air-to-fuel ratio of the air-fuel mixture supplied to an operating internal combustion engine. These regulations include limiting or even preventing further adjustment or changes, such as by an end user, of the manufacturer or factory setting of the proper air-to-fuel ratio for an engine to operate within these exhaust gas air pollution limits.

Many carburetors have adjustable valve assemblies, typically needle valves, which provide only limited or even no adjustment or change, such as by an end user, of the factory setting of the air-to-fuel ratio which makes it difficult for anyone not having a specialized tool to tamper with or change the factory setting of the valve assembly. Such a carburetor with a limited adjustment or tamperproof needle valve assembly and requiring a specialized tool for adjusting or changing the factory setting of the needle valve is disclosed in U.S. Pat. No. 7,070,173. Each of these tamperproof needle valves is threaded into a recess in the carburetor body and has a non-circular generally D-shaped head engageable only by a specialized tool with a complementary D-shaped socket to initially make or change the carburetor manufacturer or factory setting of the needle valve by rotating it. This D-shaped tool is made available by the carburetor manufacturer only to factory authorized personnel for making the factory setting of the needle valve when the carburetor is supplying an air-fuel mixture to a specific operating engine on which it is used to comply with governmental engine exhaust gas emission requirements. Typically, the tamperproof needle valve(s) of each carburetor mounted on each engine are adjusted by the original equipment engine manufacturer to comply with the governmental exhaust gas emissions requirements for each such engine.

SUMMARY

In at least some implementations, a rotatably adjustable valve has a head with an exterior generally cylindrical surface closely received in a complementary circular passage of a receptacle in a carburetor body with only a slight clearance between them. One form of a specialized adjustment tool may have a collet of resilient fingers insertable between the head and the passage of the receptacle and movable into firm engagement with the exterior surface of the head to enable rotary adjustment of the needle valve by rotation of the collet of the tool. In another form, the valve head may have an annular groove in the exterior cylindrical surface and is rotatably adjustable by another specialized tool having hooks received in the groove and an opposed member movable to firmly bear on an outer end face of the head for rotary adjustment of the valve by rotating this tool.

In another form, a cylindrical valve head can have a cylindrical pocket therein into which fingers of a collet of another specialized adjustment tool are received and expanded to firmly engage the cylindrical side surface of the pocket to enable rotary adjustment of the needle valve by rotation of the collet fingers of this tool.

In another form, a cylindrical pocket of a cylindrical valve head has one or more notches or recesses therein and extending generally radially outward toward or through the outer cylindrical surface of the valve head and in each notch or recess a dog is received of another specialized adjustment tool inserted into the pocket to enable rotary adjustment of the needle valve by rotation of this tool when this dog is received in the notch or recess.

After the factory adjustment of each of these needle valves is complete, each of these tools may be disengaged and removed from the head of the valve and thereafter the factory adjustment or setting of the valve cannot be tampered with or changed by using conventional readily available hand tools such as needle nose pliers, Allen wrenches, Torx drivers, screwdrivers, etc.

BRIEF DESCRIPTION OF THE DRAWINGS

The following detailed description of the preferred forms of the valve adjustment assembly and complementary specialized adjustment tools and best mode will be set forth with reference to the accompanying drawings, in which.

DETAILED DESCRIPTION OF PRESENT PREFERRED EMBODIMENTS

Figure 1:
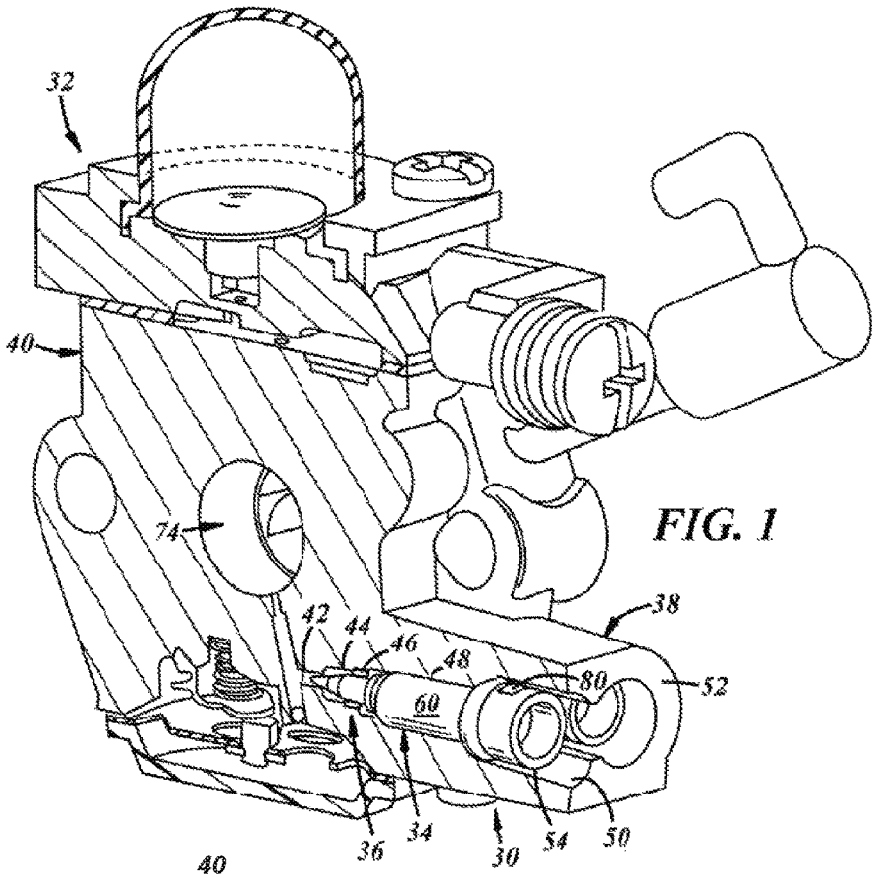
FIG. 1 is a perspective sectional view of a carburetor including a first form of an air-to-fuel ratio mixture adjustment assembly of the invention.
Figure 2:
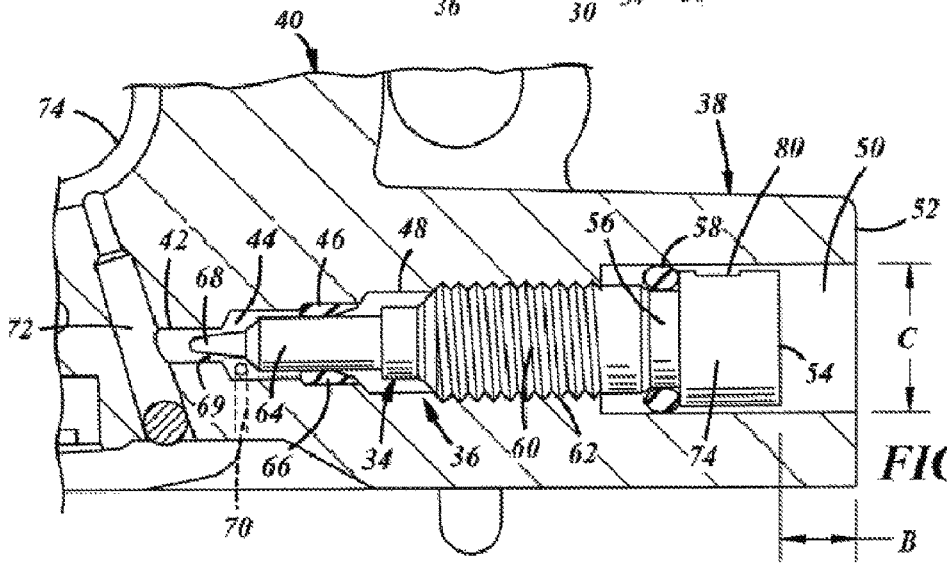
FIG. 2 is a fragmentary sectional side view of the carburetor and adjustment assembly of FIG. 1.

Referring in more detail to the drawings, FIGS. 1 and 2 illustrate an apparatus 30 embodying this invention for adjusting the air-to-fuel ratio of an air-fuel mixture supplied by a carburetor 32 to an operating engine. The apparatus includes at least one needle valve 34 and typically two needle valves 34 each received in a separate receptacle 36 in a boss 38 of a main body 40 of the carburetor. Each receptacle has a bore 42 defining a fuel passage and a series of substantially concentric and cylindrical counterbores defining a fuel chamber 44, a seal chamber 46, a threaded passage 48, and a valve head passage 50 opening through the exterior end 52 of the boss. In some carburetors 32, the main body 40 is die cast aluminum or white metal and these counterbores have a 1° or 2° side draft and are not machined, but rather used as cast and are still considered to be cylindrical for the purposes of this invention.

The needle valve 34 has a one-piece body with a head 54, preferably a groove 56 for receiving an O-ring seal 58, a threaded shank 60 engageable with complementary threads 62 in the passages 48, a cylindrical portion 64 engageable with a seal 66 received in the chamber 46 and a tapered tip 68. In assembly, the tip 68 extends into the fuel passage 42 and defines an orifice 69 between them and by rotation of the valve 34 the tapered tip 68 can be axially advanced and retracted to change the size or effective flow area of the orifice 69 to adjust the air-to-fuel ratio of the air-fuel mixture. Typically, the carburetor has one needle valve 34 to adjust the air-to-fuel ratio for idle and low speed operation of the engine and a second needle valve 34 to adjust the air-to-fuel ratio for high speed and wide open throttle engine operation. Typically, each needle valve 34 is made of metal such as steel, stainless steel or brass although for some applications it may be a plastic material such as nylon.

As shown in FIG. 2, in use of the carburetor 32, fuel flows through a passage 70 into the fuel chamber 44, through the orifice 69 into the passage 42 and then through a passage 72 into an air and fuel mixing passage 74 of the carburetor.

The carburetor 32 may be a diaphragm carburetor (which is illustrated in FIG. 1), a float bowl carburetor or any other type of carburetor which utilizes a needle valve to adjust the air-to-fuel ratio of the air-fuel mixture supplied by the carburetor to an operating engine.

The head 54 of the needle valve 34 has a generally coaxial cylindrical exterior surface 74 with a diameter slightly less than the diameter of the passage 50 in which it is received in assembly and an inner recess or pocket 76 with an interior cylindrical sidewall 78 and in which pocket a specialized tool may be received for rotating the needle valve. A slot or notch 80 extends generally radially outwardly of the pocket 76 and preferably through the exterior cylindrical surface 74 of the head 54.

Figure 3:
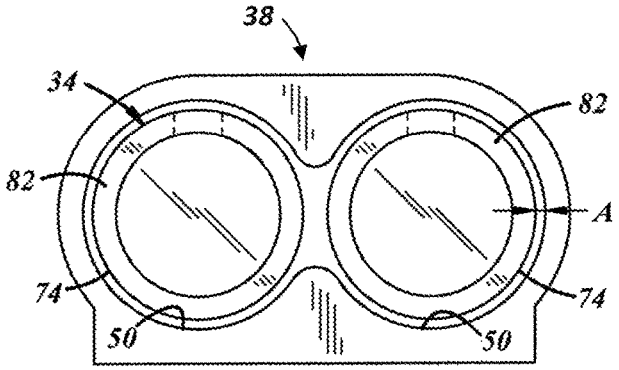
FIG. 3 is an enlarged fragmentary end view of the carburetor and adjustment assembly of FIGS. 1 & 2.
Figure 4:
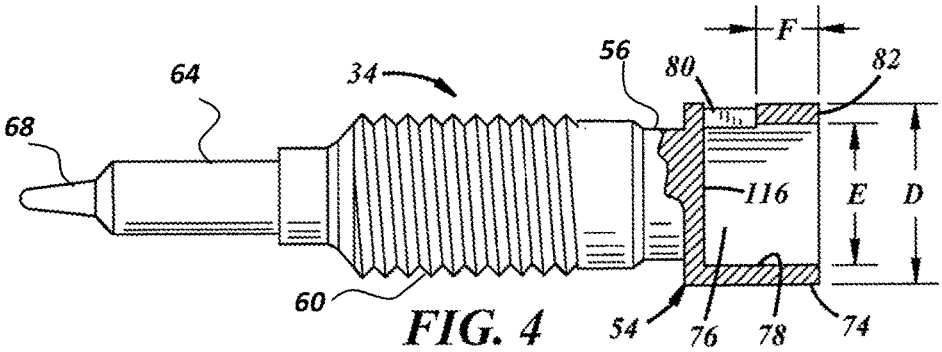
FIG. 4 is an enlarged side view partially in section of needle valves of the adjustment assembly of FIG. 1.
Figure 5:
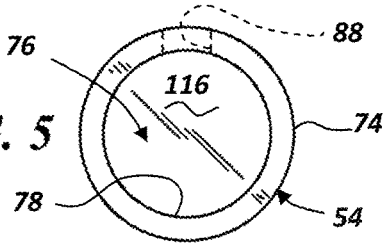
FIG. 5 is an enlarged end view of the head of the needle valves of FIG. 4.

To prevent forced engagement and rotation of the needle valve 34 by a needle nose pliers, or the like, the maximum radial clearance A (FIG. 3) between the exterior cylindrical surface 74 and the cylindrical passage 50 is not greater than 2.5 millimeters (mm), desirably 2.0 mm, and preferably 1.5 mm, and the outer end face 82 of the head 54 is received in the passage 50 axially inwardly of the outer end face 52 of the boss 38 by an axial distance B (FIG. 2) of at least 1 mm and preferably 2 mm. The maximum diameter C of the cylindrical passage 50 (FIG. 2) in the carburetor body 40 is preferably 6.70 mm and the minimum diameter D (FIG. 4) of the exterior cylindrical surface 74 of the valve head is preferably 4.95 mm. Preferably, the inside diameter E (FIG. 4) of the pocket 76 in the head is 3.35±0.30 mm, i.e., in the range of 3.00 to 3.70 mm. This diameter E is small enough to prevent forced engagement of the head with a T 20 Torx driver or a 4 mm or 9/64" Allen wrench. This diameter E is also too big for engagement by a T 15 Torx driver or a 3 mm or 1/8" Allen wrench. Preferably, the minimum axial distance F (FIG. 4) between the outer end face 82 of the head 54 and the outboard edge of the notch 80 is 2 mm. Thus, once the needle valve 34 is assembled in the recess 36 of the carburetor and rotatably adjusted to provide the desired air-to-fuel ratio of the air-fuel mixture supplied to an operating engine so that it does not exceed governmental exhaust gas emissions requirements, the needle valve setting cannot be tampered with or adjusted or changed using conventional tools such as those typically available to an end user of the engine.

Figure 6:
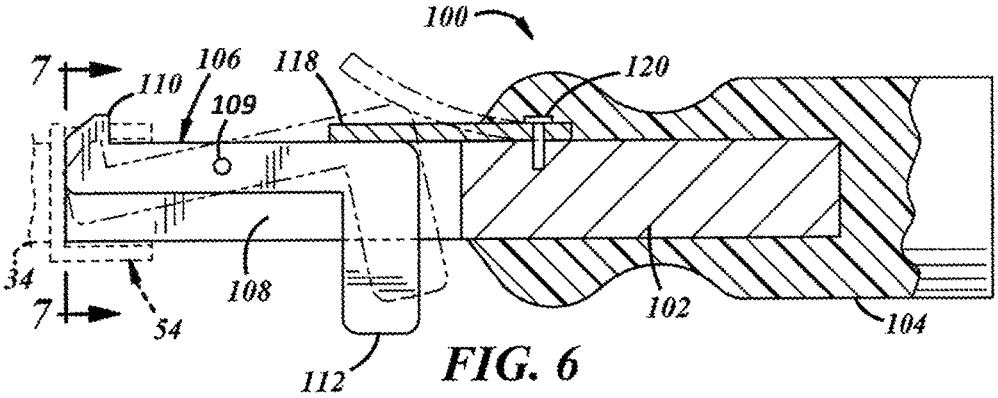
FIG. 6 is a side view with portions broken away and in section of a specialized adjustment tool for rotatably adjusting the needle valve of FIGS. 1-5.
Figure 7:
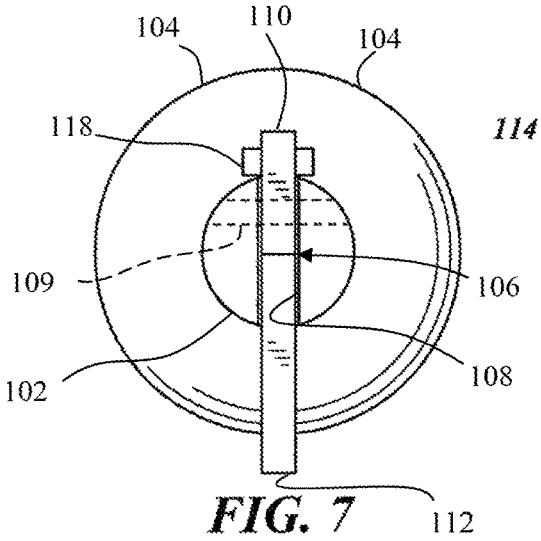
FIG. 7 is an enlarged end view of the adjustment tool of FIG. 6 taken along the line 7-7 of FIG. 6.
Figure 8:
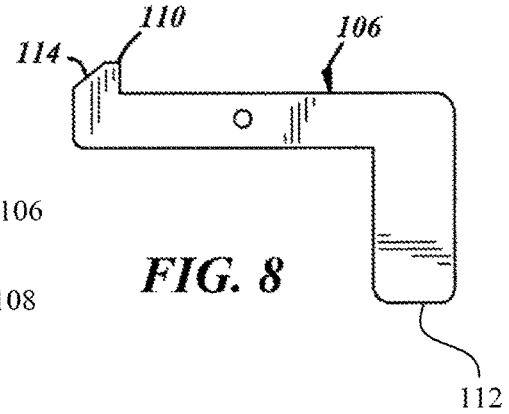
FIG. 8 is an enlarged side view of a latch member of the adjustment tool of FIG. 6.

A specialized tool 100 suitable for rotatably adjusting the needle valve 34 is shown in FIGS. 6-8. This tool has a shank 102 fixed in and axially extending from a handle 104. A lever arm 106 is received in a slot 108 through the free end of the shank 102 and pivotally mounted therein by a pin 109 extending transversely through the lever arm and the shank. As shown in FIGS. 6 and 8, the lever arm 106 has a generally radially extending dog 110 adjacent one end and a tab 112 adjacent the other end which in assembly extends generally radially outwardly of the shank 102. The dog 110 is configured so that it can be received in the notch 80 in the valve 54. Preferably, the leading edge or end 114 of the dog is tapered or inclined rearwardly to provide clearance with the bottom end 116 of the pocket 76 as the dog 110 is moved in an arc generally radially into and out of the notch 80 in the valve head.

In assembly, a leaf spring 118 attached to the shank 102 by a screw 120 yieldably biases the lever arm 106 to the position shown in solid line in FIG. 6 in which the dog 110 projects generally radially outwardly of the shank. By manually gripping the handle and pressing with a thumb the tab 112 toward the shank, the dog 110 can be retracted into the shank as shown in phantom line in FIG. 6. The shank has an outside diameter smaller than the diameter E of the pocket 76 of the needle valve 34 so that when the dog 110 is retracted, the dog and the adjacent end of the shank may be inserted into the pocket 72 and then rotated so that the dog becomes aligned with and moves generally radially outwardly into the notch 80 in the head (as shown in FIG. 6).

When the dog 110 is received in the notch 80, the handle 104 of the tool can be manually rotated to rotate the needle valve 34 to advance or retract its tip 68 to provide the desired air-to-fuel ratio of the air-fuel mixture supplied by the carburetor to an operating engine. Once the desired rotary setting of the needle valve is obtained, the tab 112 may be pressed radially inwardly against the bias of the spring 118 to retract and disengage the dog 110 from the notch 80 in the valve head 54 and then the tool 100 can be withdrawn generally axially from the pocket 76 in the head to remove the tool 100 from the needle valve 34. Thereafter, the adjusted position or setting of the needle valve 34 cannot be changed by conventional hand tools and it is necessary to utilize the special tool 100 to do so.

Figure 9:
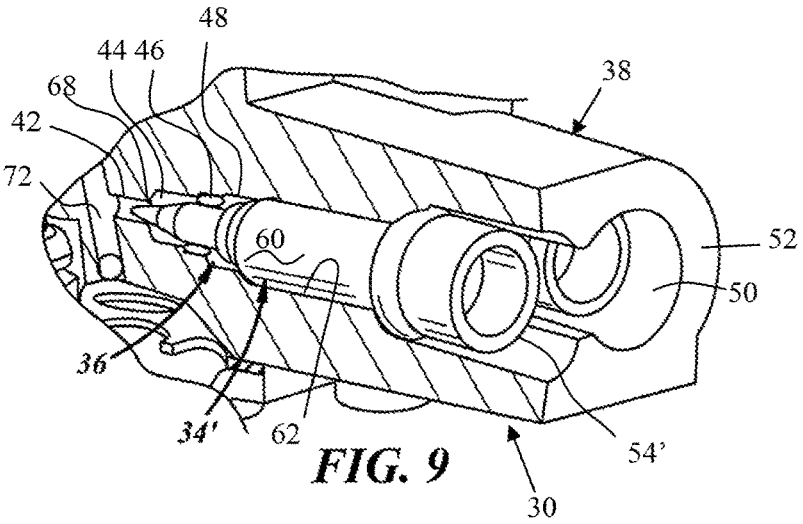
FIG. 9 is a fragmentary perspective view of the carburetor of FIG. 1 with a second form of adjustable needle valves received therein.
Figure 10:
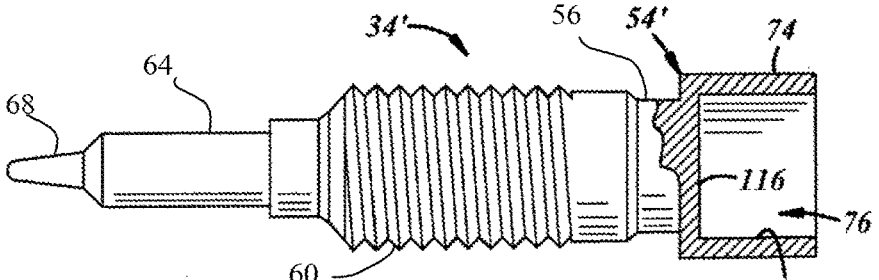
FIG. 10 is an enlarged side view partially in section of the second form of the needle valves of FIG. 9.
Figure 11:
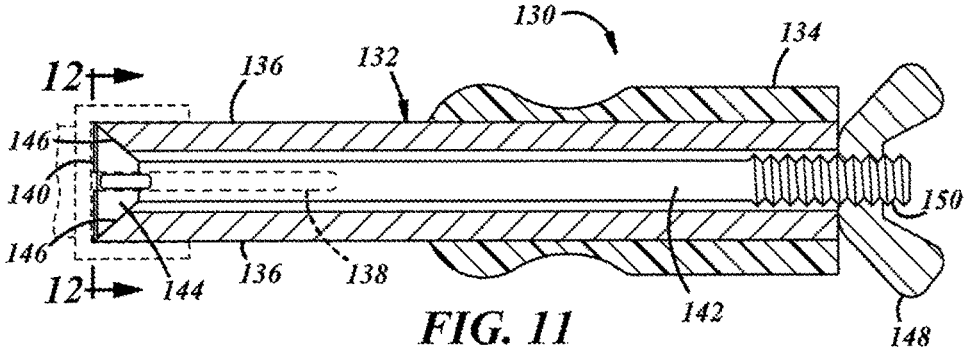
FIG. 11 is a sectional view of a second specialized adjustment tool for rotatably adjusting the second form of the needle valves of FIGS. 9 and 10.
Figure 12:
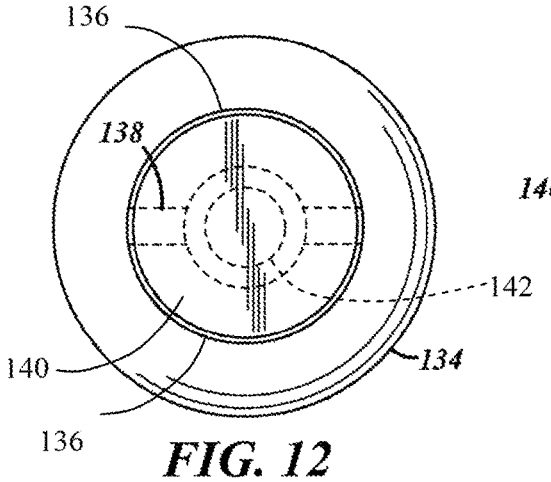
FIG. 12 is an enlarged end view of the second adjustment tool of FIG. 11 taken along the line 12-12 of FIG. 11.
Figure 14:
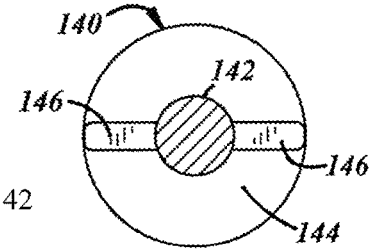
FIG. 14 is a sectional view taken on the line 14-14 of FIG. 13.
Figure 13:
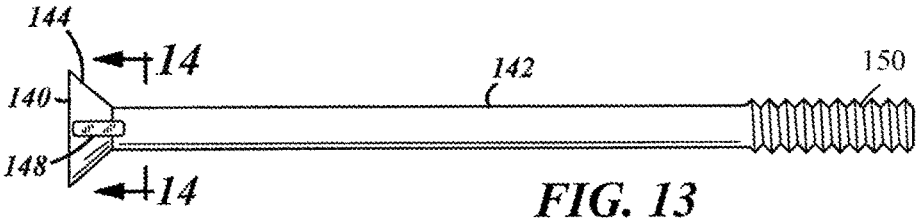
FIG. 13 is a side view of a cam head and rod of the second tool of FIG. 11.

FIG. 9 illustrates a second form of needle valves 34' received in the receptacles 36 of the carburetor 32. As shown in FIG. 10, the needle valve 34' is identical to the needle valve 34 except that it does not have any radial slot or notch 80 in its head and thus both the inner cylindrical surface 78 of its pocket 76 and the outer cylindrical surface 74 of its head 54' are circumferentially continuous and uninterrupted.

FIGS. 11-14 illustrate a second specialized tool 130 for engaging the pocket 76 of the head 54' and rotating the needle valve 34' to adjust the air-to-fuel ratio of the air-fuel mixture produced by the carburetor. This tool has a hollow cylindrical shank or tube 132 extending through and fixed to a handle 134. Two or more collet fingers 136 are formed in the free end of the tube 132 by two or more slots 138 extending axially and radially through the free end of the tube. The fingers 136 are somewhat flexible and preferably resilient and can be moved generally radially outwardly by a cam head 140 on one end of a rod 142 extending generally coaxially and slidably through the tube 132. The cam head 140 has a frusto-conical cam surface 144 engageable with complementary follower surfaces 146 on the ends of the fingers 136 and at least one and preferably two diametrically opposed tabs 148 project radially outwardly of the rod 142 and each is slidably received in one of the slots 138 to limit rotation of the rod relative to the tube 132 while permitting axial movement in unison of the cam head and rod. As an alternative to the tabs 138, a small diameter pin could be disposed transversely through the rod 142 and/or cam head 140 and extend into the slots 138 to limit rotation of the cam head and rod relative to the tube 132 of the tool 130.

In their unflexed state, the perimeter of the fingers 136 has a diameter at least somewhat smaller than the diameter E of the cylindrical pocket 76 of the head 54' of the needle valve 34'. To move the fingers generally radially outward, the cam 140 can be moved generally axially into the tube 132 by rotating a wing nut 148 threaded onto a complementary threaded portion 150 of the rod 142 extending out of the other end of the tube 132.

In use of the tool 130 to rotate the needle valve 34', the free ends of the collet fingers 136 in their unflexed state are inserted generally axially into the cylindrical pocket 76 and the handle 134 is manually gripped while the wing nut 148 is rotated to move the cam head 140 generally axially inwardly to bear on the ends 146 of the collet fingers 136 and move them generally radially outwardly into firm frictional engagement with the cylindrical sidewall 78 of the pocket 76 of the valve head 54'. Thereafter, the tool 130 is rotated to rotate and axially advance or retract the needle valve 34' to thereby adjust and set the air-to-fuel ratio of the air-fuel mixture supplied by the carburetor to an operating engine so that its exhaust gas emissions comply with governmental regulations. Thereafter, the wing nut 150 is rotated to permit the cam head 140 to move outwardly so that the collet fingers 136 move generally radially inward and disengage from the cylindrical pocket wall 78, and then the tool 130 is generally axially removed from the pocket 76 of the valve head 54' without changing the setting or rotary adjustment of the valve 34'. Thereafter, the rotary setting of the needle valve 34' cannot be tampered with or changed by using ordinary hand tools, and it is necessary to utilize a specialized tool such as the tool 130 to change the setting or rotary adjustment of the needle valve 34'.

Figure 15:
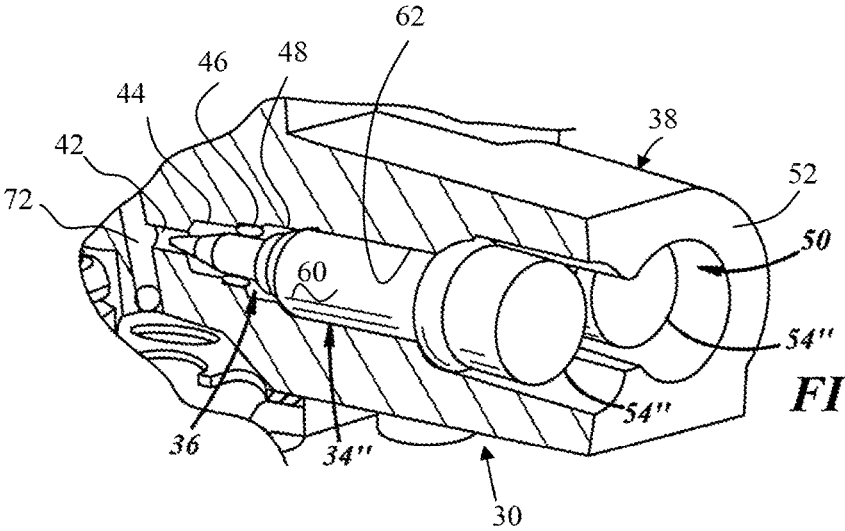
FIG. 15 is a fragmentary perspective view partially in section of the carburetor of FIG. 1 with a third form of adjustable needle valves received therein.
Figure 16:
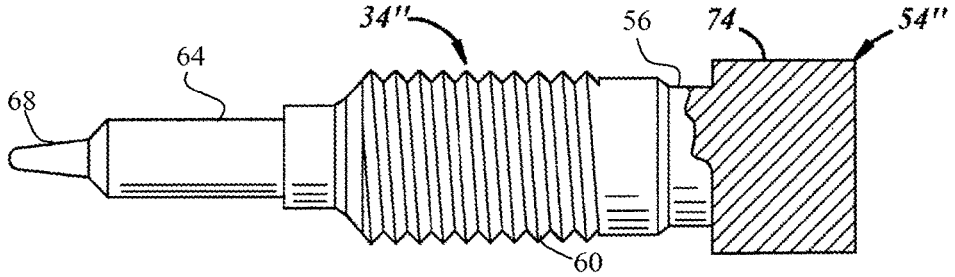
FIG. 16 is an enlarged side view partially in section of the third form of the needle valves of FIG. 15.

FIG. 15 illustrates a third form of needle valves 34" received in the receptacles 36 in the boss 38 of the body 40 of the carburetor 32. As shown in FIGS. 15 and 16 each needle valve 34" is identical to the needle valve 34 except that its head 54" does not have a pocket therein and is a solid cylindrical head with a circumferentially continuous exterior surface 74.

Figure 17:
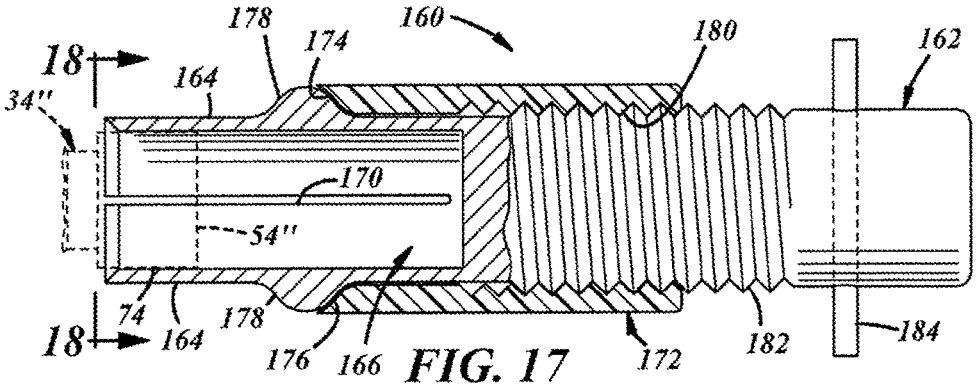
FIG. 17 is a sectional side view of a third specialized adjustment tool for rotatably adjusting the third form of the needle valves of FIGS. 15 and 16.
Figure 18:
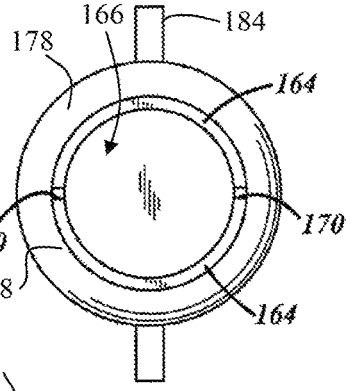
FIG. 18 is an enlarged end view of the adjustment tool of FIG. 17 taken along the line 18-18 of FIG. 17.

A specialized tool 160, illustrated in FIGS. 17 & 18, can be used to engage head 54" and rotate needle valve 34" to adjust it to provide a desired air-to-fuel ratio of an air-fuel mixture produced by the carburetor 32. The tool 160 has a preferably cylindrical shank 162 with two or more somewhat flexible and preferably resilient fingers 164 formed by a blind bore 166 in one end of the shank and slots 170 extending axially into and radially through at least a portion of this end of the shank and preferably equally circumferentially spaced apart around the perimeter of this end of the shank. In assembly, the shank 162 is received in an annular cam sleeve or collar 172 which preferably is circumferentially continuous and has a tapered or frusto-conical cam surface 174 on one end engageable with complementary follower surfaces 176 on an annular rib portion 178 on the exterior of each finger 164 and preferably extending generally circumferentially around its associated finger. Adjacent the other end, the collar 172 has an internal threaded portion 180 threadably engageable with complementary external threads 182 on the shank. A pin 184 extends transversely and preferably diametrically through the shank 162 and extends radially outwardly of the shank to facilitate manually gripping and holding the shank 162 while manually rotating the collar 172. As an alternative to the pin 184 through the shank, a knob can be attached thereto or integral therewith to facilitate manually holding the shank. To facilitate inserting the fingers 164 in their unflexed state into the cylindrical passage 50 is the recess 12 and over the head 54" of the needle valve 34", the fingers collectively have an outside diameter somewhat smaller than the inside diameter C of the passage 50 and an inside diameter somewhat larger than the outside diameter D of the valve head 54".

To use the tool 160 to rotate the needle valve 34" while assembled in the recess 12, the collet fingers 164 in the unflexed state are inserted generally axially into the passage 50 and over the head 54" of the valve 34" and then preferably the collar 172 is manually rotated relative to the shank to move the cam surface 174 of the collar into engagement with the follower surfaces 176 of the collet fingers 164 to move the fingers generally radially inward into firm frictional engagement with the exterior cylindrical surface 74 of the head 54" of the valve 34". While frictionally engaging the head 54", the tool can be rotated to advance or retract the needle valve 34" to change and adjust the air-to-fuel ratio of the air-fuel mixture supplied by the carburetor to an operating engine to maintain the engine exhaust gas pollutants within the limits established by governmental regulations. Thereafter, the collar 172 can be manually rotated while manually holding the shank to retract the cam surface 174 to disengage it from the cam follower surfaces 176 of the collet fingers 164 to return them to their unflexed position, thereby disengaging the fingers from firm frictional engagement with the head 54" of the valve 34", and then the tool 160 can be generally axially withdrawn from the head and the passage 54. Thereafter, the adjustment of the needle valves 34" cannot be tampered with or changed by the use of commonly available hand tools and their setting can be changed only by using the tool 160 to do so.

Figure 19:
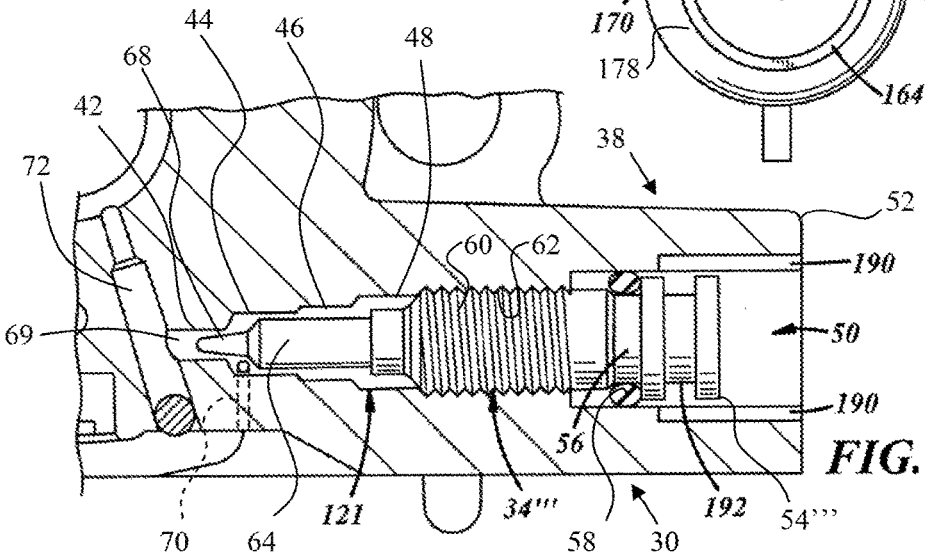
FIG. 19 is an enlarged fragmentary sectional view of a modified form of the receptacle passage of the carburetor body of FIG. 1 with a fourth form of a needle valve received therein.
Figure 20:
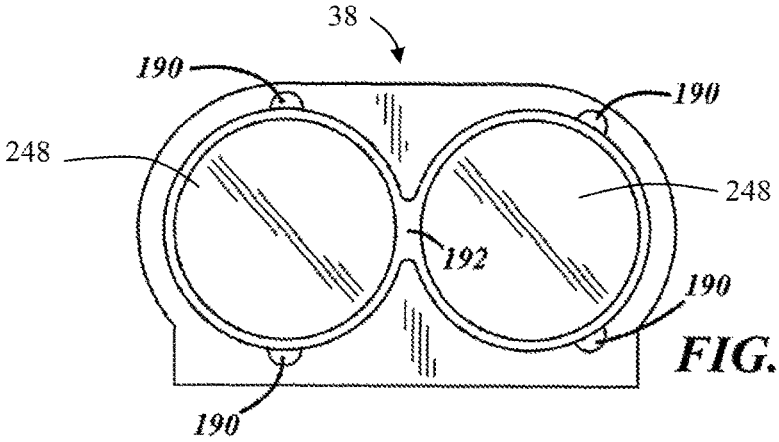
FIG. 20 is an enlarged end view of the receptacles and needle valves of FIG. 19.
Figure 21:
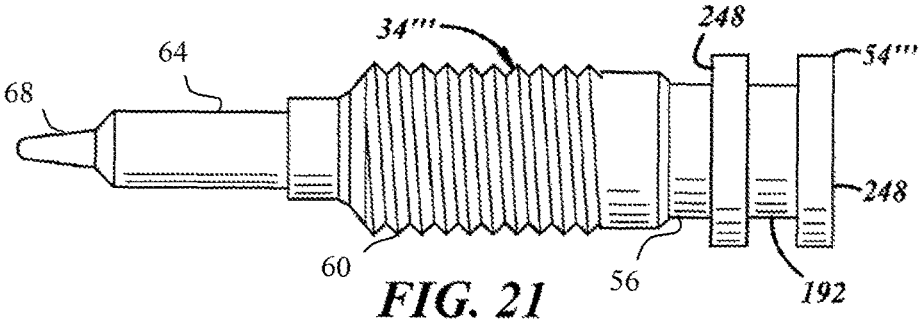
FIG. 21 is an enlarged side view of the needle valves of FIGS. 19 & 20.

FIGS. 19-21 illustrate modified receptacles 12' of the carburetor 32 with a fourth form of needle valves 34" received therein. Each receptacle 12' is the same as the receptacle 12 of the carburetor 32 except that it has two elongate slots or grooves 190 extending axially into the valve head passage 50 and terminating short of the O-ring groove 56 when the needle valve 34" is received in the recess 12'. To accommodate a specialized tool having two pivoted lever arms, the grooves 190 can be equally circumferentially spaced apart or diametrically opposed as shown in FIG. 19 and the left hand side of FIG. 20 or to accommodate a tool having three pivoted lever arms, the two grooves may be 120° apart as shown in the right-hand side of FIG. 20 and equally circumferentially spaced apart with the center area 192 in which the valve head passages 50 of the two receptacles 12' open into each other.

As shown in FIGS. 19 and 21, each needle valve 34" is identical to the needle valve 34 except that its head 54" has a circumferentially continuous groove 192 therein opening into the outer cylindrical surface 74 of this head, and this head does not have any pocket therein. The outer cylindrical surface 74 of this head has a diameter D somewhat smaller than the diameter C of the cylindrical passage 50 of the receptacles 12'.

Figure 23:
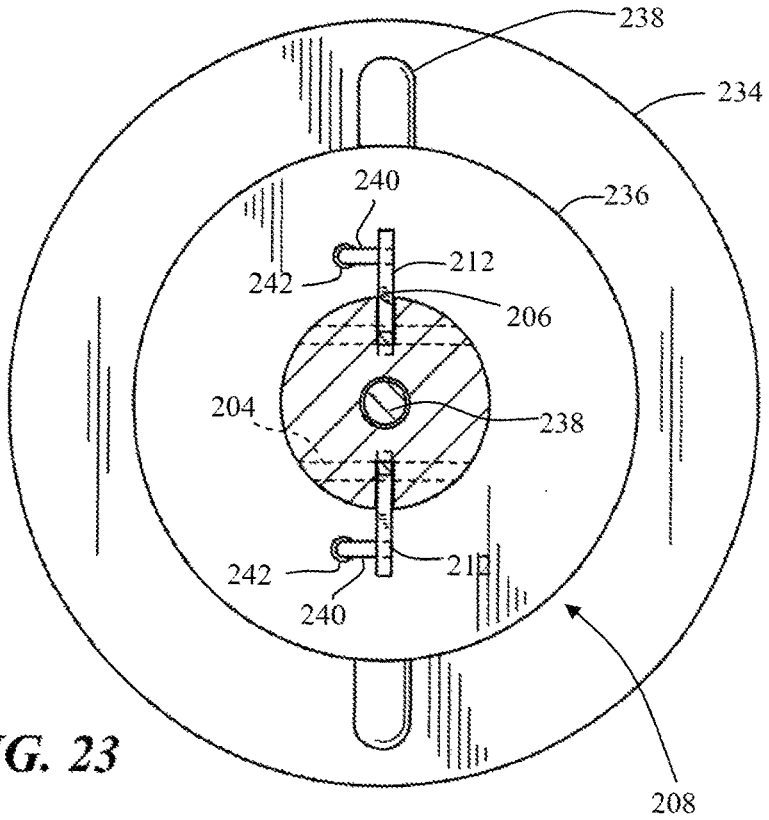
FIG. 23 is an enlarged sectional view taken on line 23-23 of FIG. 22.
Figure 22:
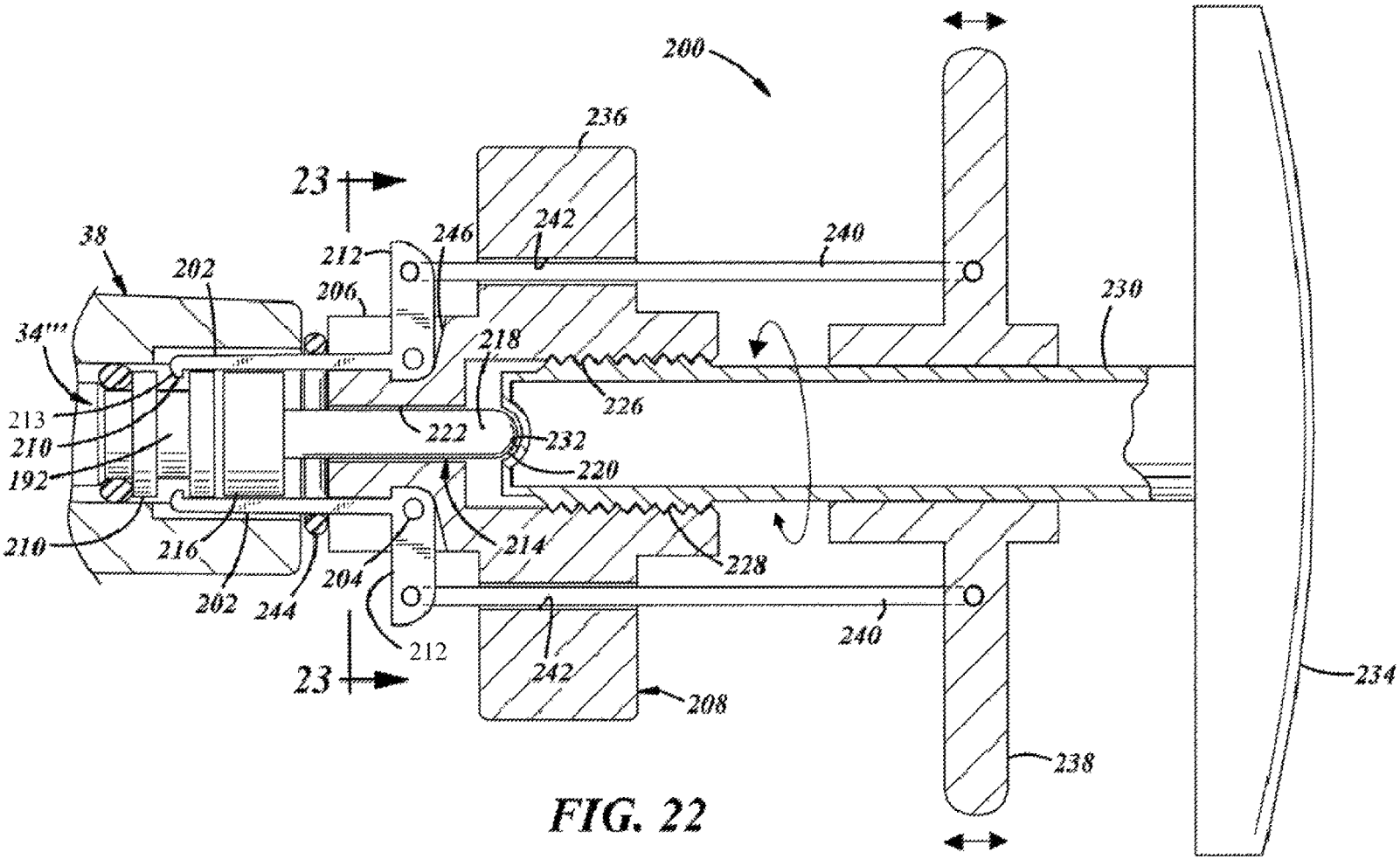
FIG. 22 is a side view partially in section of a fourth specialized adjustment tool for rotatably adjusting the fourth form of the needle valves when received in the modified receptacles of FIGS. 19 & 20 of the carburetor of FIG. 1.

When the needle valve 34" is received in the recess 12', it can be rotated by a specialized tool 200 illustrated in FIGS. 22 and 23. Tool 200 has two lever arms 202 each pivotally mounted by a pin 204 in an axially and radially outwardly extending recess 206 in a generally cylindrical carrier body 208 with the lever arms and recesses being equally circumferentially spaced apart around the longitudinal axis of the carrier body. Tool 200 is shown with two lever arms 202 and complementary recesses although it may be constructed with three or more preferably equally circumferentially spaced-apart lever arms and recesses. Each lever arm 202 has a radially inwardly extending dog or hook 210 at one end and a generally radially outwardly extending drive arm 212 adjacent the other end and is preferably made in one piece. To provide clearance for generally radial pivotal movement of the hooks 210 into and out of the groove 192 in the valve head 54", preferably the end or edge 213 of each hook is tapered or inclined inwardly toward the back face of the hook.

A clamp pin 214 with a cylindrical head 216 and a shank 218 preferably with a semi-spherical tip 220, is slidably and rotatably received in a preferably coaxial bore 222 in the carrier body 208. The carrier body has an internal threaded portion 226 therein engageable with a complementary threaded portion 228 of a cylindrical actuator rod or tube 230. Tube 230 has a semi-spherical recess 232 at one end engageable with the semi-spherical pin tip 220 and adjacent the other end a knob 234 facilitating manual rotation of the actuator tube relative to the carrier body 208 to generally advance or permit retraction of the clamp pin 214 relative to the carrier body. A radially extending flange or knob 236 is fixed to or integral with the carrier body 208 to permit the carrier body to be manually held while rotating the tube 230 to advance or permit retraction of the clamp pin 214.

To pivot the lever arms 202 to move the hooks 210 generally radially outward, an actuator collar 238 is slidably received on the tube 230 and connected by wires or preferably rigid links 240 extending through clearance holes 242 in the carrier body 208 and pivotally connected at one end to an associated drive arm 212 and at the other end pivotally connected to the actuator collar 238. The lever arms 202 are yieldably biased generally toward each other by an O-ring or a coil spring 244 overlying and encircling them, and located generally axially between the hooks 210 and drive arms 212. Preferably, the extent to which the hooks 210 of the lever arms may be moved generally radially outward is limited by their drive arms 212 engaging a stop end surface 246 of the recess 206 in which each lever arm is received.

To use the tool 200 to rotate a needle valve 34'" received in an associated recess 12', the actuator collar 238 is manually gripped and moved toward the knob 234 to pivotally move the hooks 210 and associated ends of the lever arms 202 generally radially outwardly sufficiently so that the lever arms may be generally axially inserted through the clearance grooves 190 into the passage 50 so that the hooks pass over the axially outward portion of the head 54" and overlie the groove 192 therein, whereupon the actuator collar is manually released and the bias of the O-ring or coil spring 244 moves the hooks radially inwardly into the groove 192 and through the links 240 retracts the actuator collar 238 relative to the carrier body 208. Then the actuator tube 230 is rotated preferably by manually turning the knob 234 while manually holding the carrier body 208 to generally axially advance the head 216 of the clamp pin 214 into firm preferably frictional engagement with an outer end face 248 of the valve head 54" and draws the hooks 210 into firm engagement with a sidewall 248 of the groove 192 in the head, and then the tool as a whole can be rotated to rotate the needle 34" to advance or retract its tip 68 relative to the orifice 69 to adjust the air-to-fuel ratio of the air-fuel mixture supplied by the carburetor to an operating engine so that its exhaust gas emissions are within the limits of governmental regulations. After the needle valve 34" is rotated to its desired position, the tube 230 is manually rotated while manually holding the carrier body 208 to retract the tube relative to the carrier body so that the clamp pin 214 is released and can be disengaged from the outer end face 248 of the head 54" of the needle valve 34" without rotating or changing the setting or adjusted position of the needle valve. Then the actuator collar 238 can be manually moved toward the knob 234 of the tube 230 and the tool is rotated so that the free end of each lever arm 202 will move into one of the grooves 190 in the passage 50 so that the hooks 210 are removed from the valve head groove 192, and then the tool is manually moved generally axially outward and away from the head and out of the recess 12' and removed from the recess. After this tool is removed from the recess, the setting or adjusted rotary position of the needle valve 34" cannot be changed by any conventional hand tools such as Torx drivers, Allen wrenches, needle nose pliers, screwdrivers or the like. Accordingly, the specialty tool 200 must be used to make any further adjustments or changes in the adjusted position of the needle valve 34".

Each of the presently preferred dimensions A, B, C, D, E and F, is applicable to each of the needle valves disclosed herein and the valve head passage 50 of the receptacle 12 or 12' associated with each needle valve. The dimension B insures that even after the needle valves have been adjusted to their desired setting, their heads do not extend outwardly beyond the end face 52 of the boss 38 of the carburetor body 40 in which they are received and thus cannot be rotatably adjusted by using ordinary hand tools. However, for the needle valves 34 and 34' with pockets in their heads, the dimension B could be decreased or even 0.0 mm so long as after their desired adjustment, their heads do not extend outward of the end face 52 of the boss 38.

The collet fingers of each of the tools 130 and 160 may be made of spring steel, stainless steel or steel and are somewhat flexible and resilient within their elastic limits to the extent they are flexed or displaced from their unflexed position. The handles and knobs of each tool may be made of plastic or a metal such as steel and any of the other components of each tool may be made of steel unless some other material is specifically stated for a given component. The carburetor body is typically made of aluminum or white metal although it may be made of other material for a given application as may be readily determined by persons skilled in the art.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A carburetor for an engine comprising:

a body having a mixture passage for supplying an air-fuel mixture to an operating engine;

a valve receptacle in the body having a passage with a cylindrical surface and the passage open to the exterior of the body;

a valve rotatably received in the receptacle in the body for adjusting the air-to-fuel ratio of the air-fuel mixture and having a head with an exterior cylindrical surface and an outer end face received in the passage with the outer end face disposed axially wholly within the passage and with a slight clearance between the head cylindrical exterior surface and the passage cylindrical surface of not more than 2.5 mm and the outer end face of the head being disposed axially inboard of or flush with the outboard end of the passage, wherein the valve further comprises a cylindrical pocket in the valve head which is at least substantially concentric with the exterior cylindrical surface of the valve head.

2. The carburetor of claim 1 wherein the maximum diameter of the cylindrical passage is 6.70 mm and the minimum diameter of the exterior cylindrical surface of the valve head is 4.95 mm.

3. The carburetor of claim 1 wherein the cylindrical pocket in the valve head has a diameter in the range of 3.00 to 3.70 mm.

4. The carburetor of claim 1 wherein the cylindrical pocket in the valve head has a circumferentially continuous and uninterrupted surface which is concentric with the exterior cylindrical surface of the head.

5. The carburetor of claim 1 wherein the valve head is solid, the exterior cylindrical surface of the valve head is at least substantially uninterrupted throughout, and the outer end face of the valve head is disposed axially inboard at least 1 mm from the outboard end of the cylindrical surface of the passage.

6. The carburetor of claim 1 wherein the valve further comprises a tapered tip at an end of the valve distal from the cylindrical head and between them a cylindrical threaded portion coaxial with the tip and engageable with a complementary threaded portion of the receptacle.

7. A tool for rotatably adjusting a valve with a head having an exterior cylindrical surface and a pocket in the head with an inner cylindrical surface with the valve received in a receptacle of a carburetor with a passage of the receptacle open to the exterior of the carburetor and the passage having a cylindrical surface with the head received in the passage, the tool comprising:

a tubular shank;

at least two collet fingers carried by the shank and each extending generally axially to a free end having a generally circumferentially extending portion and collectively the circumferentially extending portions have an outside diameter smaller than the diameter of the inside cylindrical surface of the pocket of the head of the valve;

a follower surface on at least a portion of the free end of each finger and tapering generally radially and axially inward relative to the outer circumferential surface portion of its associated finger;

a cam having a cam surface complementary to and engageable with the follower surfaces of the finger;

a rod received in the tubular shank and adjacent one end attached to the cam and adjacent another end having a threaded portion extending generally axially outwardly of the tubular shank;

a knob carrying complementary threads engaged with at least some of the threads of the threaded portion of the rod; and the knob is rotatable in one direction relative to the rod to move the cam surface into engagement with the followers to move the end portions of the fingers generally radially outward into firm engagement with at least a portion of the inner cylindrical surface of the pocket of the head when the end portion of each finger is received in the pocket of the head so that rotation of the fingers in unison with the cam rotates the valve to adjust an air-to-fuel ratio of an air-fuel mixture supplied by the carburetor to an operating engine, and rotation of the knob relative to the shank in a direction opposite to one direction of rotation of the knob permits the fingers to move generally radially inward to release the fingers from firm engagement with the inner cylindrical surface of the pocket of the valve head so that the fingers can be generally axially removed from the valve head without rotating the valve.

8. The tool of claim 7 further comprising a slot between adjacent fingers and a tab or pin carried by and projecting generally radially outward of the rod and into the slot to limit rotation of the rod relative to the tubular shank.

9. The tool of claim 7 which also comprises a handle attached to the shank for manually gripping the handle while manually rotating the knob.

10. The tool of claim 7 wherein the knob bears on one end of the shank or the handle when being rotated to move the cam to engage the fingers and move the fingers generally radially outward into firm engagement with the inner cylindrical surface of the pocket of the head of the valve.

11. The tool of claim 7 wherein the cam has a frustoconical cam surface engageable with the follower surfaces of the fingers and the maximum diameter of the cam is smaller than the diameter of the inner cylindrical surface of the pocket of the head of the valve.

12. A tool for rotatably adjusting a valve with a head having an exterior cylindrical surface and received in a receptacle of a carburetor with a passage of the receptacle open to the exterior of the carburetor and having a cylindrical surface and the head is received in passage, the tool comprising:

a shank having a cylindrical threaded portion;

at least two collet fingers carried by the shank adjacent the threaded portion and each extending generally axially to a free end distal from the threaded portion and at least adjacent the free end having a generally circumferentially extending portion and collectively the circumferentially extending portions have an outside diameter smaller than an inside diameter of the passage of the receptacle;

an annular collar having internal threads complementary with and engaging the threads of the cylindrical portion of a shank and adjacent one end of the collar, a cam surface inclined to a longitudinal axis of the collar and engageable with a complementary follower surface on an exterior portion of each of the fingers and axially spaced from the ends of the fingers; and the cam and follower surfaces are configured so that rotation in one direction of the collar relative to the shank moves the cam surface into engagement with the follower surfaces to move portions of an internal surface of each finger adjacent its associated free end into firm engagement with the exterior cylindrical surface of the head of the valve when the end portion of each finger is received between the cylindrical head and the cylindrical surface of the passage of the receptacle so that rotation of the collar and fingers in unison rotates the valve to adjust an air-to-fuel ratio of an air-fuel mixture supplied by the carburetor to an operating engine, and rotation of the collar relative to the shank in a direction opposite to the one direction of rotation retracts the cam surface of the collar relative to the follower surfaces of the fingers to release the fingers from firm engagement with the exterior surface of the valve head so that they can be generally axially removed from the valve head and the passage without rotating the valve.

13. The tool of claim 12 wherein the circumferentially extending portions have an inside diameter larger than the diameter of the exterior cylindrical portion of the head of the valve.

14. The tool of claim 12 wherein the radial thickness of the portion of each finger to be received between the valve head and the passage of the receptacle is not more than 2.5 mm.

15. The tool of claim 12 wherein the shank has an end axially spaced from the collar, and a manually grippable knob is attached to the shank adjacent this end and spaced from the collar and configured for manually holding the shank while manually rotating the collar relative to the shank.

16. The tool of claim 12 further comprising on each finger a rib on the exterior of and extending generally circumferentially along at least a portion of each finger and having the follower surface on at least a portion of the rib.

17. The tool of claim 12 further comprising a surface of the free end of each finger inclined to the axis of the shank and tapering generally axially and radially inward relative to the exterior surface of the finger adjacent the free end of the finger to facilitate alignment with and generally axial insertion of the fingers over the exterior cylindrical surface of the head of the valve.

18. A tool for rotatably adjusting a valve with a head having a cylindrical surface, the tool comprising:

a shank having an axis;

at least two fingers carried by the shank with each finger having a free end with a generally circumferentially extending portion and collectively the circumferentially extending portions define a first diameter in an unflexed state of the fingers;

a follower surface on at least a portion of each finger;

a cam having a cam surface engageable with the follower surfaces of the finger, the cam being axially movable relative to the shank so that the cam surfaces engage the follower surfaces and radially flex the fingers to change the size of the first diameter to permit the fingers to selectively frictionally engage the cylindrical surface of the valve head.

19. The tool of claim 18 wherein the first diameter is an outer diameter, and the cam surfaces are arranged to selectively increase the first diameter.

20. The tool of claim 18 wherein the shank first diameter is an inner diameter of the shank in the area of the fingers, and wherein the cam surfaces are arranged on an outer surface of the fingers to selectively decrease the first diameter.

21. The tool of claim 18 wherein the cam includes threads and wherein the tool includes a threaded member that threadedly engages the cam threads so that upon rotation of the threaded member the cam moves relative to the shank.

22. The tool of claim 18 which also includes a rod received in the tubular shank wherein the rod includes the cam surfaces and wherein the rod defines the threaded member.

23. The tool of claim 18 wherein the threaded member is defined by a collar in which the shank is received, and wherein the collar and shank include complementary threads so that rotation of either the collar or the shank moves the cam surfaces relative to the follower surfaces.

* * * * *